US010194692B2

(12) United States Patent
Disner

(10) Patent No.: US 10,194,692 B2
(45) **Date of Patent: *Feb. 5, 2019**

(54) DEVICE AND METHOD FOR VAPORIZING A SUBSTANCE

(71) Applicant: Daniel John Disner, Trinidad, CO (US)

(72) Inventor: Daniel John Disner, Trinidad, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/985,205

(22) Filed: May 21, 2018

(65) Prior Publication Data

US 2018/0332893 A1 Nov. 22, 2018

Related U.S. Application Data

(63) Continuation of application No. 15/411,978, filed on Jan. 21, 2017, now Pat. No. 9,974,333.

(51) Int. Cl.
*A24F 47/00* (2006.01)

(52) U.S. Cl.
CPC ..... *A24F 47/006* (2013.01); *A24F 47/008* (2013.01)

(58) Field of Classification Search
None
See application file for complete search history.

(56) References Cited

U.S. PATENT DOCUMENTS

| | | | | |
|---|---|---|---|---|
| 4,846,199 | A | 7/1989 | Rose | |
| 5,574,052 | A | 11/1996 | Rose | |
| 5,944,025 | A | 8/1999 | Cook | |
| 6,178,969 | B1 | 1/2001 | St. Charles | |
| 8,424,537 | B2 | 4/2013 | Rosenthal | |
| 9,155,848 | B2 | 10/2015 | Emarlou | |
| 9,474,304 | B2 | 10/2016 | Born | |
| 9,974,333 | B1 * | 5/2018 | Disner | A24F 47/006 |
| 2002/0074006 | A1 | 6/2002 | Gunn | |

* cited by examiner

*Primary Examiner* — Tho D Ta
(74) *Attorney, Agent, or Firm* — Merchant & Gould P.C.

(57) ABSTRACT

A simple vaporizing device with four concentric tubes and a wire mesh wick for volatizing, by vaporization, and inhaling one or more constituents of various vaporizable substances. The device is operated using the flame from a standard butane cigarette lighter or other flame producing devises as the sole heat source, and the user's inhalation process for air flow. Concentric tubes, an inner tube with two open ends to provide a direct pathway for the flow of air and vapor; and outer tubes with open ends, one moveable, are arranged to provide for the application, vaporization, and delivery of the vaporizable substance as a single dose.

18 Claims, 2 Drawing Sheets

DEVICE AND METHOD FOR VAPORIZING A SUBSTANCE

CROSS-REFERENCE TO RELATED APPLICATIONS

This application is a continuation application of U.S. patent application Ser. No. 15/411,978 (now U.S. Pat. No. 9,974,333), entitled "DEVICE AND METHOD FOR VAPORIZING A SUBSTANCE," filed on Jan. 21, 2017, the entire disclosure of which is hereby incorporated herein by reference.

REFERENCES TO RELATED PATENTS

| | | |
|---|---|---|
| 9,474,304 | Born and Davis | Oct. 25, 2016 |
| 8,424,537 | Rosenthal | Apr. 23, 2-13 |
| 9,155,848 | Emarlou | Oct. 13, 2015 |

REFERENCES TO OTHER MATERIALS https://www.wired.com/2016/02/exploding-e-cigs-and-vape-pens/—exploding battery https://youtu.be/xS8LsPv1_uM—battery failure: fire

BACKGROUND OF THE INVENTION

This invention relates to the field of heat vaporization of various substances, such as plant extracts and medicines to produce vapors for inhalation.

All other devices identified through market and patent search, and intended for facilitating the volatizing and inhaling of the constituents of various vaporizable substances (substance[s]), such as medicines and plant materials, and commonly referred to as, among other, 'vaporizers', 'dab tubes', 'dab pipes', 'dab pens', and 'nectar collectors', rely on, 1) electronic elements to heat and vaporize the substance or, 2) application of a flame to a heating surface or element so as to bar contact of the flame with the substance and, 3) the use of a separate utensil for the application of the substance to the device. Further, they do not provide an adequate process by which the user can effectively control dosage. The design of these devices is intended to produce a vapor from a substance without the possibility of combustion of the substance. The desire of other devices to completely eliminate combustion in the vaporization process necessitates the use of complex designs, often incorporating electronic systems, which complicate the manufacturing process and user experience, and provide numerous opportunities for device failure (i.e. see: https://www.wired.com/2016/02/exploding-e-cigs-and-vape-pens/, https://youtu.be/xS8LsPv1_uM)

BRIEF SUMMARY OF THE INVENTION

This invention, the Flash Dab, employs, 1) the use of a flame, avoiding failure caused by electrical malfunction (including the possibility of explosion or fire), 2) a simple design providing for a direct line of air and vapor flow from distal to proximal end and, 3) incorporating use of the vaporizing wick as application utensil. Further, the design and function of the wick as application utensil provides the user with the ability to easily control dosage.

The function of the wick, and its placement within this device, is to limit contact between the substance and the applied flame limiting, while not necessarily eliminating, the amount of combustion taking place in the vaporization process. The specific placement of the wick within the device is such that the tip of the wick protrudes beyond the intake end of the barrel where it, and the portion of substance contained therein, is exposed to direct flame. The remainder of the wick, and the portion of substance contained therein, is located within the barrel where it is heated by way of conduction through the metal mesh and the passage of hot gasses and vapors from the heating chamber. The design of the heating chamber is such as to allow only the oxygen-depleted gasses of the flame to enter, thereby limiting or eliminating combustion of the substance as those hot gasses pass through the wick.

BRIEF DESCRIPTION OF THE SEVERAL DRAWINGS

All drawings represent the prototype of the current invention for a finished length of 5.25 inches.

FIG. 6 shows the hood component comprising 1.5 inches of round brass tubing of 7/32" diameter.

FIG. 7 shows the outer of 2 sleeves comprising 0.75 inch of round brass tubing of 3/16" diameter.

FIG. 8 shows the inner of 2 sleeves comprising 1 inch of round brass tubing of 5/32" diameter.

FIG. 9 shows the long inner tube comprising 5 inches of round brass tubing of 1/8" diameter.

DETAILED DESCRIPTION OF THE INVENTION

The prototype device is 5.25 inches in length. Variations in length and other dimensions are anticipated. The specifications of the materials used in the prototype are listed in the preceding section entitled 'BRIEF DESCRIPTION OF THE SEVERAL DRAWINGS'.

Figure 3:
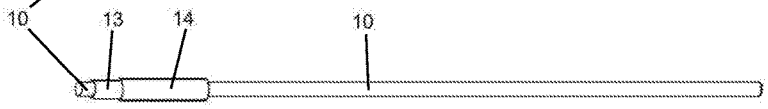
FIG. 3 shows the device stem with both sleeves crimped in position over the long inner tube.
Figure 4:
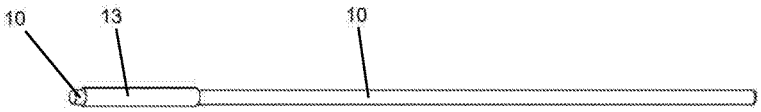
FIG. 4 shows the device stem partially assembled with the inner sleeve in position over the stem.
Figure 5:
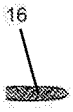
FIG. 5 shows the wick, comprised of 80-mesh brass screen tightly rolled and crimped at distal end.
Figure 6:
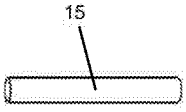
FIG. 6-9 show components of the invention, all comprising round brass tubing with wall thickness of 0.014 inch
Figure 7:
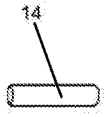
Figure 8:
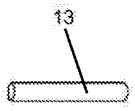
Figure 9:
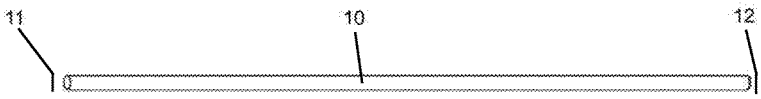

The device comprises 5 components: one long hollow metal tube (10); one first short hollow metal tube (13) positioned concentrically around the long tube (10) and crimped permanently in place; one second short hollow metal tube (14), slightly shorter than first tube (13), positioned concentrically around the first (13) and crimped permanently in place to comprise the stem (FIG. 3); one wick (16) comprised of tightly rolled fine wire metal mesh, crimped at one end, that is inserted into the stem at the distal end leaving approximately 1/3 of its length, crimped end, exposed and 2/3 within the long stem component tube (10); one short hollow metal tube (15) positioned concentrically around the stem (FIG. 3) so as to enclose the two short tubes and wick at the distal end of the stem, forming a heating chamber (FIG. 10), and attached in a manner so as to allow it to slide back and forth over the distal end of the device without detaching from the device.

Figure 1:
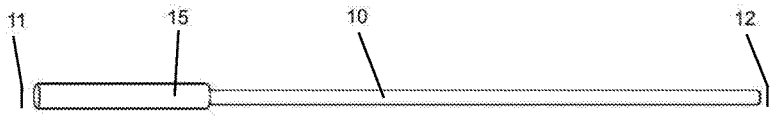
FIG. 1 shows the finished device with the hood in the closed position.
Figure 2:
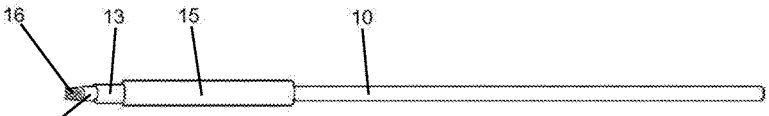
FIG. 2 shows the finished device with the hood in the open position.
Figure 10:
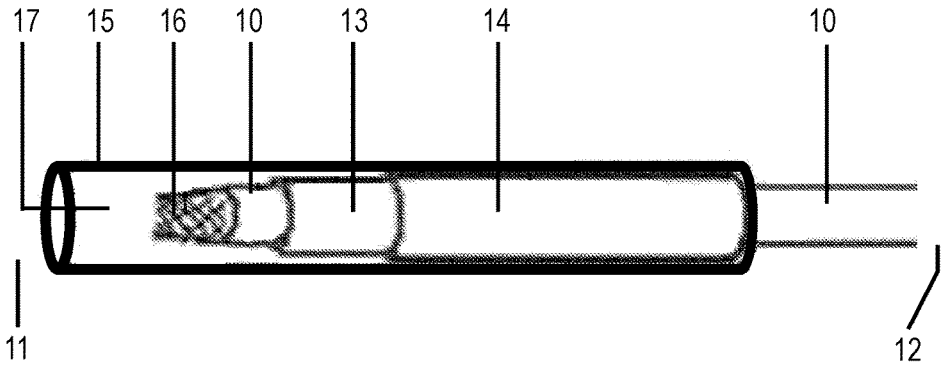
FIG. 10 shows an exploded view of the distal end of the device as represented in FIG. 1, where the various components form the heating chamber of the device.

In use, the hood (15) is slid back toward the proximal end (12), exposing the wick (16) and tips of the sleeves (13, 14) so that a substance can be applied to the wick (FIG. 2). In the case of a substance with a wax-like consistency, the wick is heated so as to melt and draw the substance into the wick. The substance is applied to the wick by putting the wick in direct contact with the substance. The hood is then slid forward to encase the distal end of the device including the wick and tips of the sleeves (FIG. 1) to form the heating chamber (FIG. 10). A flame is applied to the distal end of the device (11) and the user sucks on the proximal end (12) to draw the flame and hot gasses of the flame into the heating chamber (FIG. 10) and through the wick, where the substance is vaporized with minimum or no combustion, and drawn through the stem (FIG. 3) and into the mouth of the user, followed by inhalation.

The invention claimed is:

1. A device for vaporizing and inhaling constituents of a vaporizable plant substance in a single dose, comprising:

a stem, comprising:

a long inner tube having an open proximal end and an open distal end; and a first short tube as a sleeve, the sleeve positioned and crimped in place around the long inner tube near the open distal end;

a wire mesh wick inserted into the stem at the open distal end, the wire mesh wick for the application and heating of the vaporizable plant substance; and a second short tube positioned concentrically around the stem to form a hood over the first short tube and the wire mesh wick, the hood sized and crimped so as to be slidable back toward the open proximate end of the stem to expose the open distal end, and slidable forward to enclose the open distal end, without detaching from the stem.

2. The device of claim 1, wherein the hood is slidable back toward the open proximal end to expose the wire mesh wick for application of the vaporizable plant substance to the wire mesh wick.

3. The device of claim 1, wherein the hood is slidable forward over the open distal end to enclose the wire mesh wick and form an open ended chamber configured to receive heat for vaporizing the vaporizable plant substance.

4. The device of claim 1, wherein the hood, in a forward position, protects the wire mesh wick from damage.

5. The device of claim 1, wherein the device comprises a plurality of tubes, and wherein the plurality of tubes comprises at least the long inner tube, the first short tube, and the second short tube.

6. The device of claim 5, wherein at least one of the plurality of tubes is formed of a metal.

7. The device of claim 5, wherein at least one of the plurality of tubes is of an inner diameter (ID) and an outer diameter (OD) that allows the at least one tube to slide over at least one other tube.

8. A method of volatizing and inhaling a substance comprising:

applying the substance to a wire mesh wick inserted into an open distal end of a long inner tube;

applying heat to a heating chamber at the open distal end of the long inner tube, the heating chamber comprising the wire mesh wick enclosed by a hood, the hood comprised of a short outer tube concentrically positioned around the long inner tube and at least one short inner tube at the open distal end of the long inner tube, and wherein the hood is sized and crimped so as to be slidable forward to enclose the wire mesh wick at the open distal end of the long inner tube; and drawing a flame and hot gasses into the heating chamber and through the wire mesh wick thereby vaporizing the substance.

9. The method of claim 8, wherein the hot gasses pass from the open distal end, through the wire mesh wick, through the long inner tube, and to the open proximal end of the device.

10. The method of claim 8, wherein the flame and the hot gasses emanate from a flame producing device.

11. The method of claim 8, wherein the substance comprises at least one extract.

12. A device for vaporizing constituents of a vaporizable plant substance, comprising:

a stem, comprising:

a long inner tube with an open proximal end and an open distal end, a first short tube and a second short tube as sleeves, the sleeves positioned and crimped in place around the long inner tube near the open distal end;

a wire mesh wick inserted into the long inner tube at the open distal end, the wire mesh wick for the application and heating of the vaporizable plant substance; and a third short tube positioned concentrically around the stem to form a hood over the sleeves and the wire mesh wick, the hood sized and crimped so as to be slidable back toward the open proximate end of the stem to expose the open distal end, and slidable forward to enclose the open distal end, without detaching from the stem.

13. The device of claim 12, wherein the hood is slidable back toward the open proximal end to expose the wire mesh wick for application of the vaporizable plant substance to the wire mesh wick.

14. The device of claim 12, wherein the hood is slidable forward over the open distal end to enclose the wire mesh wick and form an open ended chamber configured to receive heat for vaporizing the vaporizable plant substance.

15. The device of claim 12, wherein the hood, in a forward position, protects the wire mesh wick from damage.

16. The device of claim 12, wherein the device comprises a plurality of tubes, and wherein the plurality of tubes comprises at least the long inner tube, the first short tube, the second short tube, and the third short tube.

17. The device of claim 16, wherein at least one of the plurality of tubes is formed of a metal.

18. The device of claim 16, wherein at least one of the plurality of tubes is of an inner diameter (ID) and an outer diameter (OD) that allows the at least one tube to slide over at least one other tube.

* * * * *